US005298903A

United States Patent [19]

Janos

[11] Patent Number: 5,298,903

[45] Date of Patent: Mar. 29, 1994

[54] SYNTHETIC DIELECTRIC MATERIAL FOR BROADBAND-SELECTIVE ABSORPTION AND REFLECTION

[76] Inventor: William A. Janos, 8381 Snowbird Dr., Huntington Beach, Calif. 92646

[21] Appl. No.: 382,165

[22] Filed: May 26, 1982

[51] Int. Cl.[5] ..... H01Q 17/00

[52] U.S. Cl. ..... 342/4

[58] Field of Search ..... 343/18 A, 18 B; 342/1, 342/2, 3, 4

[56] References Cited

U.S. PATENT DOCUMENTS

| | | | |
|---|---|---|---|
| 3,441,933 | 4/1969 | Tuinila et al. | 342/4 |
| 3,721,982 | 3/1973 | Wesch | 342/1 |
| 4,371,742 | 2/1983 | Manly | 342/1 X |
| 5,212,488 | 5/1993 | Konotchick | 342/1 X |

*Primary Examiner*—T. H. Tubbesing
*Attorney, Agent, or Firm*—A. M. Fernandez

[57] ABSTRACT

Ingredients of loaded dielectric media are specified for the achievement of high absorption and/or high reflection of electromagnetic power over very broad frequency bands and with very low material mass requirements on the absorbing or reflecting agents. The loading consists of dilute distributions of small metallic particles specified in terms of their individual properties, namely electrical conductivity, permeability, size, shape, and their collective properties, i.e., number densities, metallic volume fractions. The required permittivities of sustaining dielectrics and the thicknesses or penetration depths for absorption or reflection of the loaded media are also specified. These particulate and supporting dielectric properties are scaled with respect to the electromagnetic wavelength or frequency bands for the achievement of the desired percentage power absorption and/or reflection (in nonoverlapping bands). The invention applies to all frequencies below visible optical. Typical volume fractions for aluminum are $10^{-8}$ for greater than 95% absorption and $10^{-6}$ for greater than 95%. reflection.

14 Claims, 5 Drawing Sheets

Power Reflection/Absorption of Efficient Absorbers vs β

ABSORPTION BAND OF EFFICIENT ABSORBING METALLIC PARTICLES

AL METAL, $\sigma = 10^{17}$ $Sec^{-1}$
VOLUME FRACTION, $F = 4.5 \times 10^{-8}$
A: BAND, 1 TO 10 GHz
B: BAND, 1 TO 100 GHz

REFLECTION BAND OF EFFICIENT ABSORBING METALLIC PARTICLES

AL METAL, $\sigma = 10^{17}$ $Sec^{-1}$

A: VOLUME FRACTION, F = $4.5 \times 10^{-6}$; BAND, 1 TO 10 GHz

B: VOLUME FRACTION, F = $4.5 \times 10^{-5}$; BAND, 1 TO 100 GHz

SYNTHETIC DIELECTRIC MATERIAL FOR BROADBAND-SELECTIVE ABSORPTION AND REFLECTION

ORIGIN OF THE INVENTION

This invention is based on a study performed for the Office of Naval Research under contract Number N00014-80-C-0926.

BACKGROUND OF THE INVENTION

This invention relates to material for broadband-selected absorption and reflection of electromagnetic waves for all frequencies below optical (hereinafter referred to as RF) using dilute concentrations of metallic particles suspended in a lightweight dielectric for such applications as radar cross section suppressors, microwave heat exchangers, plasma generators, transformation of RF energy into thermal optical energy, shields for RF discharge devices, etc., and lightweight RF broadband reflecting material for such applications as radar reflectors, broadband antennae with prescribed or variable gain pattern, optically transparent RF shields, EMI shields and RF filters.

Such absorptive material is useful in antenna-communication links (low elevation angles), RF microwave laboratory insulation, EMI absorptive shields. Such reflective material is useful for satellite antennas, communication links, cable television, shielding electronic computers, computer games, microwave ovens, commercial RF microwave laboratory shielding and in high RF energy discharge technology in industrial research and development. Additional utilization may be in frequency-band sensitive radar beacon reflectors, EMI filters, selective absorbers in solar heat exchange devices and RF transparent thermal insulators. Still other uses may be suggested to one skilled in the art from the following description of the invention which exploits the efficient RF absorbing and reflecting properties of dilute concentrations of small, suitably shaped metal particles and metal coated dielectric particles suspended or sustained in a low loss dielectric material. The terms metal and metallic are used interchangeably to denote materials with high electrical conductivity.

Methods of synthesizing dielectric materials with dilutely distributed metallic particles for the achievement of effective RF band-selective absorption and reflection have been limited to semiempirical trial and error recipes, tested by repeated measurement. They have the limitations of expense in the time consuming and materially costly repetitive testing and successive modification of the dielectric ingredients to achieve results that suffer from excessive mass or weight requirements and are constrained by narrow band performance, and highly complex circuitry or microcircuitry.

The internal electric field, and hence the electric moment of an RF irradiated particle, is derived from the perturbation solution to Green's theorem integral equation depicting the depolarizing effect of the induced surface charge and the power dissipation due to the volume current. The resultant internal field is thus the depolarized incident field within an attenuation depth from the particle surface, referred to hereinafter as skin depth. The depolarizing factor derives naturally from the integral formulation, as the internal solid angle subtended by the surface normal component of the incident electric field. The efficiency of absorbers is then characterized by their depolarizing factors, conductivities, and ac permeabilities for ferromagnetic materials.

Through the conventional Lorentz-Lorenz formulation of the composite permittivity of dilute distributions of particle dipole classes, the coefficients of power reflection and absorption of the synthetic dielectric medium are established. The penetration lengths, mass requirements and mean constitutent particle dimensions and conductivities are described or prescribed in parametric form for high absorption, and its complement, high reflection within broad frequency bands. The volume fraction parameter used in the description refers to the volume fraction of metallic conducting material.

SUMMARY OF THE INVENTION

The material for selective band interaction (absorption or reflection) of the present invention is comprised of small, metallic spheroidal (prolate or oblate) particles (solid or dielectric filled metallic shells) of low depolarizing factor, $P_e$, less than the applied radian frequency-to-conductivity ratio, $\omega/\sigma$ (esu, cgs), dilutely distributed in a supporting dielectric medium. The individual and collective RF absorbing and reflecting properties of these particles occur under the conditions that the particles be Rayleigh scatterers having at least one submicron dimension less than skin depth, $\delta r_{sk}$, given by the equation $$\delta r_{sk} = \frac{\lambda_2}{\pi} \frac{f_2}{\mu\sigma} \text{ (esu, cgs)}$$

where $\mu$ = magnetic permeability $\sigma$ = conductivity of the metallic particle $\lambda$ = wavelength of lowest frequency $f_2$ of selected band The absorption or reflection effectiveness of specified dilute concentrations of efficient metallic conducting particles of specified shapes and dimensions is dependent on their volume fraction of conductivity, namely the product of the volume fraction and electrical conductivity of their constituent metallic material. For a given RF frequency band of interest and a supporting dielectric material, adding dilute concentrations of such metallic particles will increase the volume fraction of conductivity, and hence the effective conduction current of the mixture. The phase difference of the conduction current and internal electric field, for small values of volume fraction of conductivity is correspondingly small. Thus the current is substantially in phase with the driving field or voltage, and incremental Ohmic heating power losses will occur within the volume of the material. With sufficient depth of material, all of the internally propagating electromagnetic energy will be absorbed. When the supporting dielectric is closely matched to free space or more generally to the incident medium, such as in waveguide applications, this loaded material of a given thickness or greater can function as an RF absorber for small given values of the volume fraction of conductivity of the given particles. When the permittivity of the supporting dielectric is not matched to free space or the incident medium, "first" reflection effects will reduce the total absorbing effectiveness of the material.

For RF reflection, the small volume fraction of conductivity required for absorption is increased by at least two orders of magnitude, as by increasing the concentrations of the same particles, or retaining the same particle shapes and sizes, but increasing their metallic conducting constituents, or any other modification that will still be consistent with the general specifications of the efficient conducting particles, which will produce the required increase in the product of the metallic volume fraction and conductivity. The increased product of volume fraction and electrical conductivity will then maximize the effective "conduction" current, but will also maximize the phase difference between current and voltage to 90°. The result is no net mean power loss incurred in the medium while the incident internal electric field attenuates rapidly, within a small penetration distance. The material so loaded for a thickness greater than this penetration depth, or effective "skin depth," thus behaves as a very efficient reflector. This reflection condition occurs for all values of the permittivity of the supporting dielectric.

The key parameter is the volume fraction of conductivity. For any given RF frequency bandwidth, a volume fraction of conductivity equal to approximately half that of the lowest in-band frequency will produce very high absorption within the thickness of the order of the corresponding in-band wavelength, while an increase of this volume fraction of conductivity by at least two orders of magnitude will thus produce correspondingly high reflection within a thickness of the order of one tenth the longest in-band free-space wavelength. Thus, for very good conducting metals, such as aluminum and a lower in-band frequency of 1 GHz, the corresponding volume fractions of material metal range from $10^{-8}$ for absorption to $10^{-6}$ for reflection. The constituent metallic particles should be spheroidal in shape, of ratios of minor to major axes below specified bounding values, solid metallic or metallic coated dielectric, of metallic thicknesses below specified bounding values.

Ideally, all particles would be aligned with the major axis parallel to the incident electric field, but in practice a random orientation of particles will produce one third with the proper alignment for total penetration by the incident field. To compensate for that, three times the number of particles are included in the dilute concentration than would be the case if all would be aligned.

The novel features that are considered characteristic of this invention are set forth with particularity in the appended claims. The invention will best be understood from the following description when read in connection with the accompanying drawings.

DESCRIPTION OF PREFERRED EMBODIMENTS

Internal Electric Field of Solid Metal Particles

The internal field of a Rayleigh conducting particle is depolarized at its inner boundary, with the depolarizing factor, $P_e$, equal to the average internal solid angle subtended by the component of the incident electric vector that is normal to the particle surface. Thus spheres have a constant depolarizing factor of $4\pi/3$, while ellipsoids, and (analyticaly more tractable), spheroids of very low minor to major axis aspect ratios can have very low depolarizing factors. The depolarizing factor dependence with small aspect ratio prolate spheroids or "cigar-shaped" rods, shown in FIG. 1, varies as the square of the aspect ratio, while for oblate spheroids or "pancake-shaped" disks, shown in FIG. 2, it varies directly with the aspect ratio.

Figure 1:
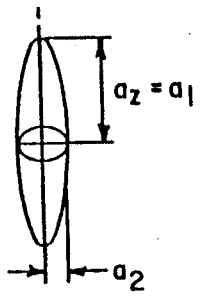
FIG. 1 is a diagram useful in understanding the geometry of solid prolate spheroids or rods of conductive material.
Figure 2:
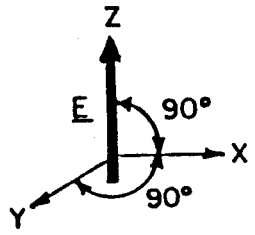
FIG. 2 is a diagram useful in understanding the geometry of solid oblate spheroids or disks of conductive material.
Figure 2:
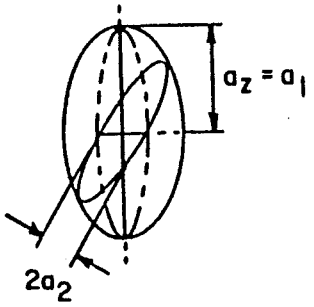

Assuming an electric field vector in the z-direction as shown in FIGS. 1 and 2, the depolarizing factor, $P_e$, is $$P_e = \iint_{\text{surface}} dy_s dz_s \frac{\partial}{\partial z} [(x - x_s)^2 + (y - y_s)^2 + (z - z_s)^2]^{-\frac{1}{2}} \quad (1)$$

direction $$P_{ez} = 2\pi \int_0^\infty dS \frac{a_x a_y a_z}{(S + a_z^2)^{3/2}(S + a_x^2)^{\frac{1}{2}}(S + a_y^2)^{\frac{1}{2}}} \quad (2)$$

In the case of spheroids, for $a_z = a_1$, $a_x = a_y = a_2$ and $a_2/a_1 < 1$, as shown in FIGS. 1 and 2, Prolate spheroid or rod, $P_e = 4\pi(a_2/a_1)^2 \ln(a_1/a_2)$ Oblate spheroid or disk, $P_e = \pi^2(a_2/a_1)$ (3)

In these and all other equations which follow, esu and cgs units are assumed. If other units are to be used, appropriate conversion factors must be introduced into the equations. The depolarized inner boundary field then is skin depth attenuated within the particle, the inner core remaining unaffected and offering excess weight. With one or more dimension less than skin depth in the submicron size range for RF-microwave, the internal field can be substantially constant and the volume power absorption to mass ratio, or absorption efficiency, maximized for the given depolarizing factor. Thus suitably oriented submicron particles with negligibly small depolarizing factors, of the order of or less than the applied frequency to conductivity ratio (esu, cgs) offer the most efficient absorption since virtually all of their conduction electrons participate.

$<E>$ is the average electric field component on the inner boundary of the spheroidal particles and in the averaged direction of an axis, say $a_k$. The averaging is over all axial orientations relative to the field direction.

$$<E_k> = \tfrac{1}{3}\left[1 - \frac{i\sigma}{\omega} P_e(k)\right]^{-1} E_{oz} \tag{4}$$

where the $\frac{1}{3}$ factor represents the effect of orientation averaging and $\sigma$=conductivity of metal (esu cgs; sec $^{-1}$)

$\omega=\pi f$, f=frequency (Hz)=c/$\lambda$

It therefore follows from equation (4) that if the depolarizing factor $P_e(k)$ $$P_e(k) < \frac{\omega}{\sigma} << 1 \text{ (for } RF \text{ and metals)} \tag{5}$$

$$\text{then } \frac{<E_k>}{E_{oz}} \simeq \tfrac{1}{3}, \tag{6}$$

if the metallic particles thicknesses are less than skin depth, $\delta r_{sk}$, which is the depth at which the transverse electric field strength attenuates to 1/e of its value on the surface, i.e., its boundary value, or, $$a_2 < \delta r_{sk} = \frac{\lambda}{2\pi}\sqrt{\frac{f}{\mu\sigma}} \tag{7}$$

where $\mu$=magnetic permeability and $\sigma$=conductivity of the metallic particle.

Equation (6) denotes that on the average $\frac{1}{3}$ of all the particles will be properly oriented for total penetration by the incident fields, but for a small but significant power loss per particle due to the Ohmic heating effect by the conduction electrons.

Spheroidal particles that possess the very low depolarizing factors given in equation (b 5) require minor to major axis aspect ratios a 2/ a1that for frequency f(Hz) and conductivity $\sigma$(sec$^{-1}$) are:

for prolate spheroids or rods, $$\frac{a_2}{a_1} < \left(\frac{\frac{f}{\sigma}}{\ln\frac{\sigma}{f} + \ln\ln\frac{\sigma}{f}}\right)^{\frac{1}{2}} \tag{8}$$

for oblate spheroids or disks, $$\frac{a_2}{a_1} < \frac{f}{\sigma} \tag{9}$$

Internal Electric Field of Metallic Shells

Figure 3:
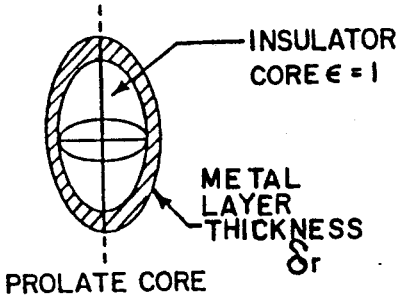
FIG. 3 is a diagram useful in understanding the geometry of a prolate spheroid or rod having a dielectric core coated with a metallic layer.
Figure 4:
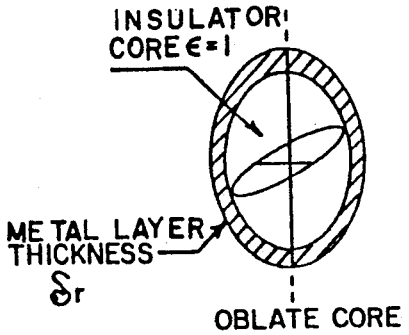
FIG. 4 is a diagram useful in understanding the geometry of an oblate spheroid or disk having a dielectric core coated with a metal layer.

The absorption properties of Rayleigh sized spheroidal metallic (metal, graphite, etc.)shells are similar in principle to the solid particles. The metallic shell surrounds a low permittivity (near free space) light weight spheroidal shaped solid dielectric, as shown in FIGS. 3 and 4. The thin shell signifies a reduction in subtended solid angle, within the metal layer, from that of the solid spheroidal shape. For the shell, the depolarizing factor of the underlying spheroid shape is multiplied by the shell thickness to semimajor axis ratio. Thus the more stringent requirements on solid particles for negligible depolarizing factors, requiring aspect ratios of less than $10^{-3}$ (rods) to less than $10^{-6}$ (disks), are reduced for their thin shell counterparts since higher aspect ratio dielectric cores can be used. On assuming a shell layer thickness of a micron, the required depolarizing factor for a prolate spheroid should be numerically less than its semimajor axis, while for an oblate spheroid less than one percent of the semimajor axis is the numerical upper bound on the depolarizing factor.

Figure 5:
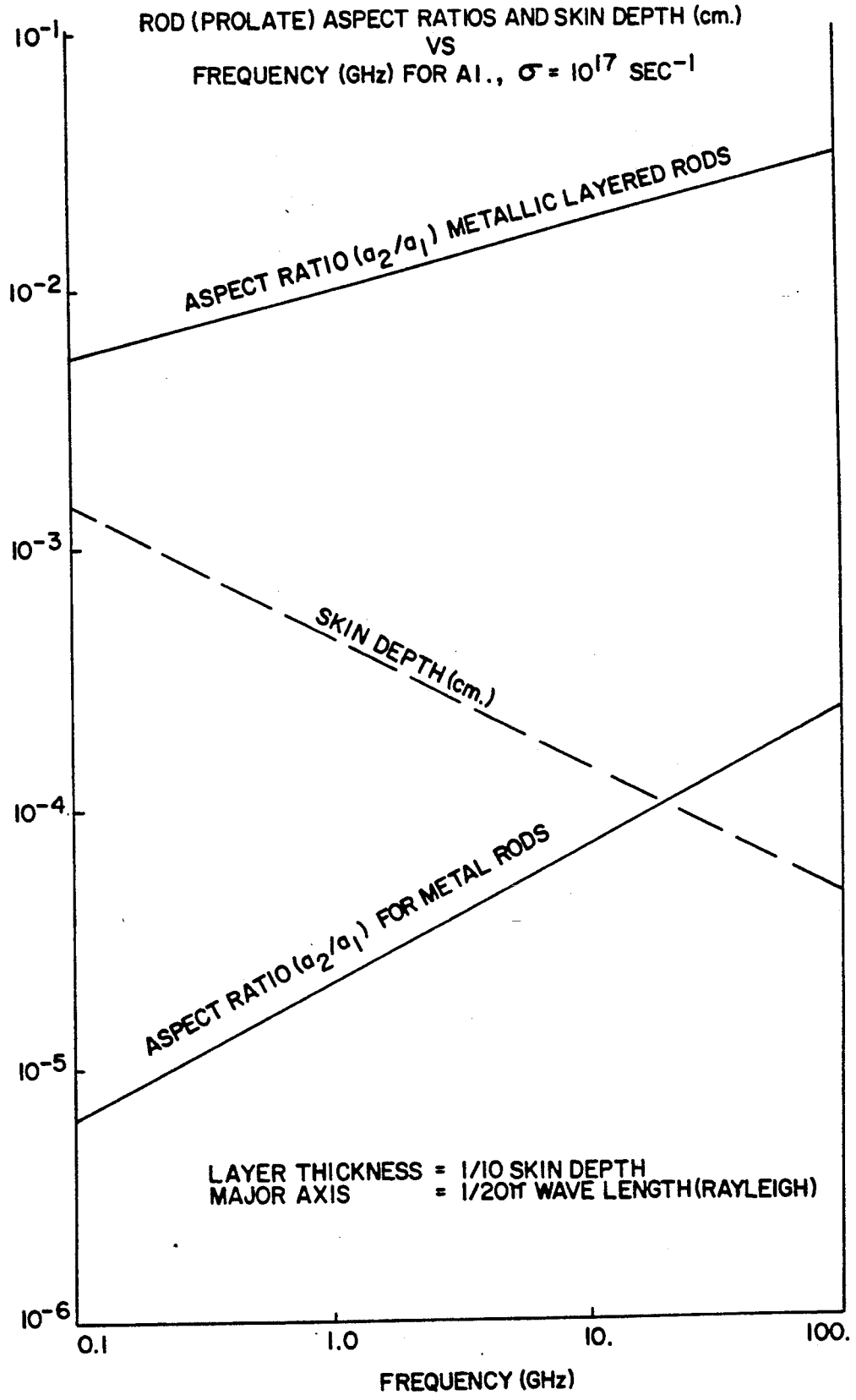
FIG. 5 is a graph of prolate particle aspect ratios and skin depth as a function of frequency for aluminum, $\sigma = 10^{17}$/sec.

As indicated above in equation (5), the required value (less than unity) of the depolarizing factor $P_e$ must be less than the frequency to conductivity ratio, $\omega/\sigma$. This applies to all conducting particles. For metallic coated particles with an insulating core which is of permittivity matched to free space or background medium, the composite depolarizing factor $P_e$ is $$P_e = \frac{\delta r_s}{r_s}\hat{P}_e(\text{core}) \tag{10}$$

where $\hat{P}_e$ is the depolarizing factor of the spheroidal core, $\delta r_s$ is the metallic layer thickness, which is less than skin depth $\delta r_{sk}$, the semiminor axis of the spheroid.

$$\text{Thus the condition on } \hat{P}_e \text{ is } \hat{P}_e < \frac{\omega}{\sigma}\frac{r_s}{\delta r_s} \tag{11}$$

a less extreme requirement on the spheroid aspect ratios For aluminum, FIG. 5 depicts the frequency dependence of the skin depth and aspect ratios of solid metal and metal coated dielectric rods.

Synthetic Dielectric Composite Permittivity of Dilute Concentrations

Figure 6:
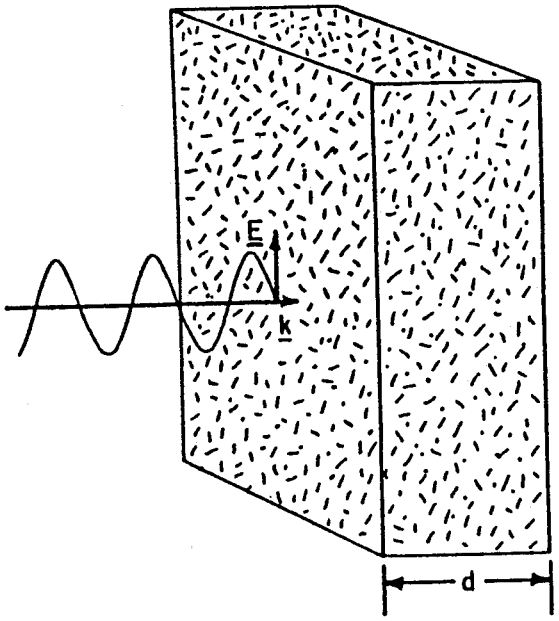
FIG. 6 illustrates a slab of low-loss dielectric material with submicron metallic particles, or metal coated insulator particles, dilutely distributed for use as an efficient absorber or reflector of electromagnetic radiation, depending upon the size of the particles in relation to the wavelength of radiation.

The composite permittivity of dilute concentrations of metal and metal-layered spheroidal particles has been established through the conventional Clausius-Mosotti, Lorentz-Lorenz formulation—the determination of the mean polarizabilities dipole moments and consequent polarization of the particle distribution. In the case of efficient absorbers, the Fresnel power reflection coefficient for slab geometry and normal incidence, as illustrated in FIG. 6, is a function of the dimensionless variable, $\beta$, proportional to the ratio of the product of conductivity and volume fraction of metallic material to applied frequency. Under these conditions the required volume fraction of efficient aluminum-like absorbers for greater than 95% reflection may be of order of or less than $10^{-6}$ while for greater than 95% absorption a volume fraction of less than $10^{-8}$ is required. For absorption by dilute distributions, the extinction depth is comparable to the wavelength of the incident field.

The composite permittivity $\epsilon$ of a synthetic or loaded dielectric composed of a basic nonpolar substrate or supporting insulator of real permittivity $\epsilon_1$ and a dilute concentration of loaded ingredients is given by the Lorentz-Lorenz formulation as $$\frac{\epsilon}{\epsilon_1} = 1 + \frac{4\pi\Sigma\alpha_{kj}\left(\frac{(\epsilon_1+2)^2}{9\epsilon_1}\right)}{1 - \frac{4\pi}{3}\Sigma\alpha_{kj}\left(\frac{\epsilon_1+2}{3}\right)} \tag{12a}$$

$$\frac{\epsilon}{\epsilon_1} = 1 + \frac{4\pi\Sigma\alpha_{kj}}{1 - \frac{4\pi}{3}\Sigma\alpha_{kj}} \tag{12b}$$

where $\alpha_{kj}$=average electric dipole moment per particle of species k, configuration j $$\alpha_{kj} = i\frac{\sigma_j}{3\omega}\frac{n_j\Delta V_{kj}}{\left(1 + i\frac{\sigma_j}{\omega}P_{ekj}\right)} = \frac{i\sigma_j}{3\omega}\frac{F_{jk}}{\left(1 + i\frac{\sigma_j}{\omega}P_{ekj}\right)} \tag{13}$$

$\sigma_j$=conductivity of species j($sec^{-1}$)

$\omega=2\pi f$ ($H_z$) ($sec^{-1}$)

$n_j$=number density of species j ($cm^{-3}$)

$\Delta V_{kj}$=particle volume of species j configuration k ($cm^3$)

$P_{ekj}$=depolarizing factor species j configuration k $F_{jk}=n_j\Delta V_{kj}$=volume fraction of k, j (metallic content).

When the substrate is nearly matched to free space or the background medium $\epsilon_1 \simeq 1$ and one species dominates, with a mean volume fraction, F, and depolarizing factor, $P_e$, $$\alpha_{kj} \simeq \alpha = \frac{i\sigma}{3\omega}\frac{F}{\left(1 + i\frac{\sigma}{\omega}P_e\right)} \tag{14}$$

where $F=n\,\Delta V$, n=mean concentration, $n\Delta V$=mean particle volume of metallic material.

Then for the required low depolarizing factor given in equation (5), it follows that $$\alpha_{kj} \simeq \alpha = \frac{i\sigma F}{3\omega} \tag{15}$$

which when substituted in the composite permittivity above reduces the expression to $$\epsilon = \frac{1 + 2i\beta}{1 - i\beta} \tag{16}$$

for the dimensionless parameter $\beta$, $$\beta = \frac{4\pi\sigma F}{9\omega} = \frac{2\sigma F}{9f} \tag{17}$$

where again

F=mean volume faction of loading particles, and f=frequency (Hz).

the Fresnel plane wave power reflection coefficient R for normal incidence on a slab dielectric of permittivity $\epsilon$ is $$R = \left|\frac{\sqrt{\epsilon} - 1}{\sqrt{\epsilon} + 1}\right|^2 \tag{18}$$

where the absolute value of the relevant complex quantities are signified thus $$R = \frac{(1 - X)^2 + Y^2}{(1 + X)^2 + Y^2} \tag{19}$$

for $$X = \sqrt{\frac{1}{2(1-\beta^2)}\left([(1-2\beta^2)^2 + 9\beta^2]^{\frac{1}{2}} + (1 - 2\beta^2)\right)} \tag{20}$$

$$Y = \sqrt{\frac{1}{2(1-\beta^2)}[(1-2\beta^2)^2 + 9\beta^2]^{\frac{1}{2}} - (1 - 2\beta^2)} \tag{21}$$

Figure 7:
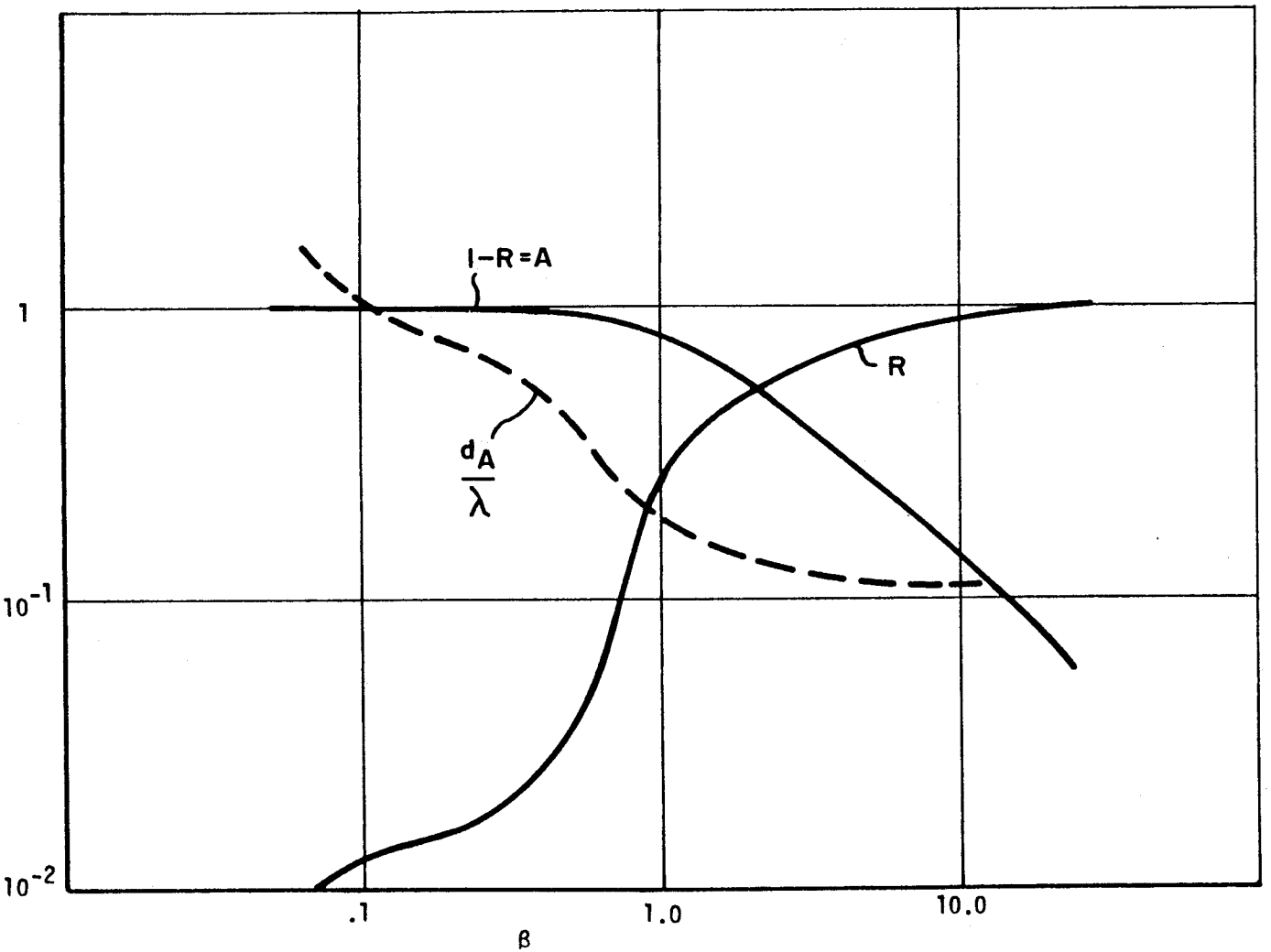
FIG. 7 is a graph of power reflection/absorption of dilute concentrations of metal or metal-coated spheroidal particles as a function of a dimensionless variable a $\beta$ (proportional to the ratio of the product of conductivity and volume fraction to applied frequency). Also included is the ratio of absorption depth to wavelength.

The fractional power reflected, R, at normal incidence is plotted as a function of $\beta$ in FIG. 7. The complement of R, which is 1−R, represents transmission and subsequent absorption through an infinitely long slab, since the composite dielectric is lossy, inasmuch as the index of refraction $n=\sqrt{\epsilon}$ has an imaginary part $$IMn = IM\sqrt{\epsilon} = y \tag{22}$$

The effective extinction depth for absorption is $d_A$ $$d_A = \frac{\lambda}{2\pi IM\sqrt{\epsilon}} = \frac{\lambda}{2\pi y(\beta)} \tag{23}$$

where $\lambda$ is the wave length of the incident electromagnetic radiation, and $d_A$ is the distance within which the electric field of the radiation will have diminished to $e^{-1}=0.369$ of its inner slab boundary value. Thus the corresponding power will have attenuated by a fraction of $e^{-2}=0.135$.

When $|\Delta|$ is appreciable, the attenuation applies to the transmitted field of fractional power 1−R. For small $\beta$ however, R is of order $\beta^2$ and almost all of the field is transmitted and attenuated. The absorption depth in this case, for $\beta<1$, is then $$d_A \simeq \frac{\lambda}{3\pi\beta} = \frac{\lambda}{3\pi\sqrt{R}} \quad (R < .05) \tag{24}$$

R, 1−R=A and $d_A/\lambda$ are plotted versus $$\beta = \frac{2\sigma F}{9f}$$

in FIG. 7

Absorption Band Requirements

The following conclusions apply to absorption band requirements for a dilute slab distribution of efficient absorbing particles. For greater than 95% absorption in the band from a minimum of $f_1$ Hz to a maximum of $f_2$ Hz:

(a) The particle thickness should be less than the skin depth of the highest frequency.

(b) The slab thickness, d, should be greater than the maximum wavelength, at the lower frequency $f_1$ of the band of interest.

Frequencies higher than $f_2$ will not penetrate the particles hence the net tangential field will tend to zero. Frequencies lower than $f_1$ will tunnel or leak through the entire slab.

Beyond the absorption band edges ($f_1$, $f_2$) the attenuation decay (or transmission rise) is sharply defined, with a steeper decay at the lower frequency $f_1$.

Efficient absorbing particles are defined by their depolarizing factors $P_e$ $$P_e < \frac{\omega}{\sigma} = \frac{2\pi f}{\sigma} \tag{25}$$

for frequencies in the RF band of interest from $f_1$ to $f_2$ Hz. Thus $$P_e < \frac{2\pi f_1}{\sigma} \tag{26}$$

will suffice.

The metal, or coating metal layer thickness $\delta r$ must be less than the minimum skin depth $\delta r_{sk}$, the skin depth associated with the highest frequency $f_2$.

$$\delta r < \delta r_{sk}(f_2) \tag{27}$$

Particle penetration of the incident field will diminish for frequencies higher than $f_2$, which correspond to skin depths less than the particle thickness. For such higher frequencies, the amount of penetrable volume fraction of metal will be reduced by a factor less than the ratio of skin depths, and as a result the relative attenuation in decibels for a fixed amount of material takes the form $$\frac{DB \text{ attenuation for } f}{DB \text{ attenuation for } f_2} \leqq \left(\frac{f_2}{f}\right)^{\frac{1}{2}}, f > f_2 \tag{28}$$

For frequencies not fulfilling the efficient absorbing particle condition, namely, $$f < \frac{\sigma}{2\pi} P_e, \tag{29}$$

the extinction depth for the composite dielectric slab is inversely proportional to the square of the frequency. In the case of efficient absorbers, namely those with depolarizing factors, $P_e$ fulfilling $$f > f_1 > \frac{\sigma}{2\pi} > P_e, \tag{30}$$

however, the extinction depth is constant. Here, $f_1$ is chosen as the lower in-band RF frequency. Thus the DB attenuation ratio for a fixed slab length matched to the longer wavelength $\lambda_1$, is $$\frac{DB \text{ attenuation } (f_1)}{DB \text{ attenuation } (f < f_1)} \geqq \left(\frac{f}{f_1}\right)^{-2}, f_1 < f_2 \tag{31}$$

Figure 8:
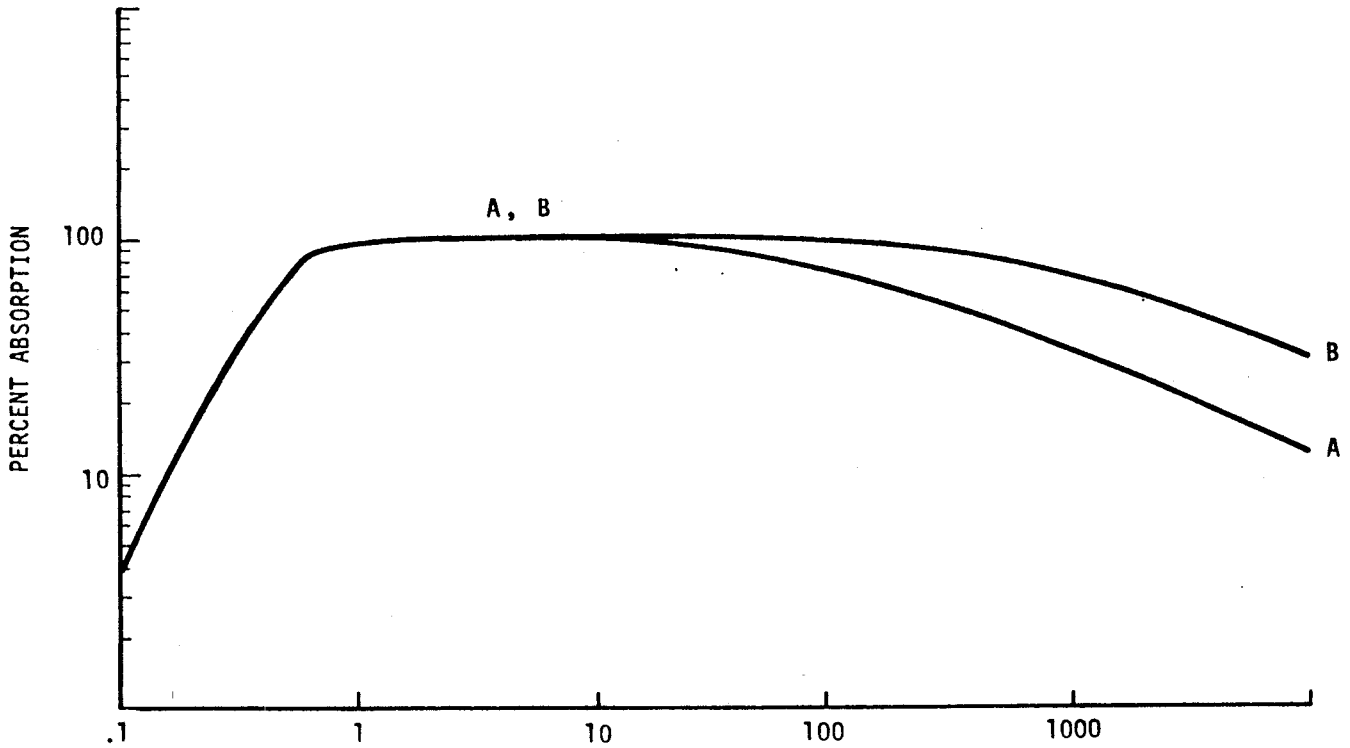
FIG. 8 is a graph of percent absorption as a function of frequency for dilute concentrations of efficient absorbing metallic particles supported in a slab of dielectric material.

The effective absorption bands for special cases of aluminum particles are shown in FIG. 8.

Reflection Band Requirements

For reflection considerations over band ($f_1$, $f_2$) the higher concentration of efficient absorbers gives rise to a sharp jump in the magnitude of the relative permittivity toward the value $-2$, resulting in higher percentage reflection. The high frequency $f_2$ condition on particle size is similar to the absorption case. The low frequency $f_1$ condition is imposed by the requirement that the effective skin depth, $\delta r$, of the slab be somewhat greater than 1/10th the maximum wavelength $\lambda_1$, again to prevent tunneling.

For reflection in the RF band ($f_1$, $f_2$) the particle size affects the volume fraction of metal that is penetrated. Thus at higher frequencies $f > f_2$ the effective volume fraction F scales as $$\frac{F(f > f_2)}{F(f \leqq f_2)} = \left(\frac{f_2}{f}\right)^{\frac{1}{2}} \tag{32}$$

The effective volume fraction is inversely proportional to the square root of the higher frequency. This results in a corresponding decrease in a which signifies a reduction in reflected power, and an increase in absorption as indicated in the (reflectivity) curves of FIG. 7

$$\beta(f > f_2) = \beta(f_2)\left[\left(\frac{f_2}{f_1}\right)^{\frac{1}{2}}\left(\frac{f_2}{f}\right)\right] = \beta(f_2)\left[\left(\frac{f_2}{f}\right)^{3/2}\right] \tag{33}$$

The reduction in $\beta$ for frequencies f higher than $f_2$ is proportional to $f^{-3/2}$.

Frequencies lower than the lowest RF band frequency $f_1$, require a longer effective skin depth for the composite slab dielectric. As a result, when the slab thickness is matched to the lowest frequency $f_1$ for reflection, frequencies lower than $f_1$ will penetrate through.

For efficient absorbing particles, over band ($f_1$, $f_2$).

$$P_e < \frac{\omega_2}{\sigma} \tag{34}$$

suffices, along with the minimal skin depth thickness.

Then inspection of the complex permittivity $\epsilon$ in equation (12*b*)for large $\beta$ indicates that $$\epsilon = \frac{1 + 2i\beta}{1 - i\beta} \simeq -2 \quad \beta >> 1 \tag{35}$$

which indicates that $\epsilon = -2$ and total reflection occurs for large $\beta$. Thus $$R = \left|\frac{\sqrt{\epsilon} - 1}{\sqrt{\epsilon} + 1}\right|^2 = 1 \quad \beta >> 1 \tag{36}$$

As shown in FIG. 7, greater than 95% reflection occurs for $\beta > 10$. This reflection takes place within the skin depth, $\delta\hat{r}_{sk}$, of the slab $$\delta\hat{r}_{sk} = \frac{\lambda}{2\pi\sqrt{2}}, \lambda_2 < \lambda < \lambda_1 \tag{37}$$

By choosing a reflecting slab thickness that is matched to the longer wavelength $\lambda_1$, or lowest frequency $f_1$, high reflection is assured for loadings of efficient absorbing particles.

Wavelengths longer than $\lambda_1$ will penetrate through and the relative reflected power will decrease on the average by $$\frac{\text{power reflected for } \lambda > \lambda_1}{\text{power reflected for } \lambda < \lambda_1} = \frac{1 - \exp[-8.89\lambda_1/\lambda]}{1 - \exp[-8.89]} \quad (38)$$

as the wavelengths λ increase, the efficiency criterion $$\omega > \sigma P_e \quad (39)$$

can no longer hold, and the particles tend to become opaque Rayleigh scatterers which contribute a negligible amount of scattering because of their dilute concentrations Thus, for wavelengths λ, $$\lambda >> 10\,\lambda_1 \quad (40)$$

the reflected power drops to a very small value, of the order of the small volume fraction of efficient absorbers for high reflection, say 95%, at wavelength $\lambda_1$.

$$R \simeq F \simeq 45\frac{f_2}{\sigma} << 10^{-4} \quad (41)$$

Figure 9:
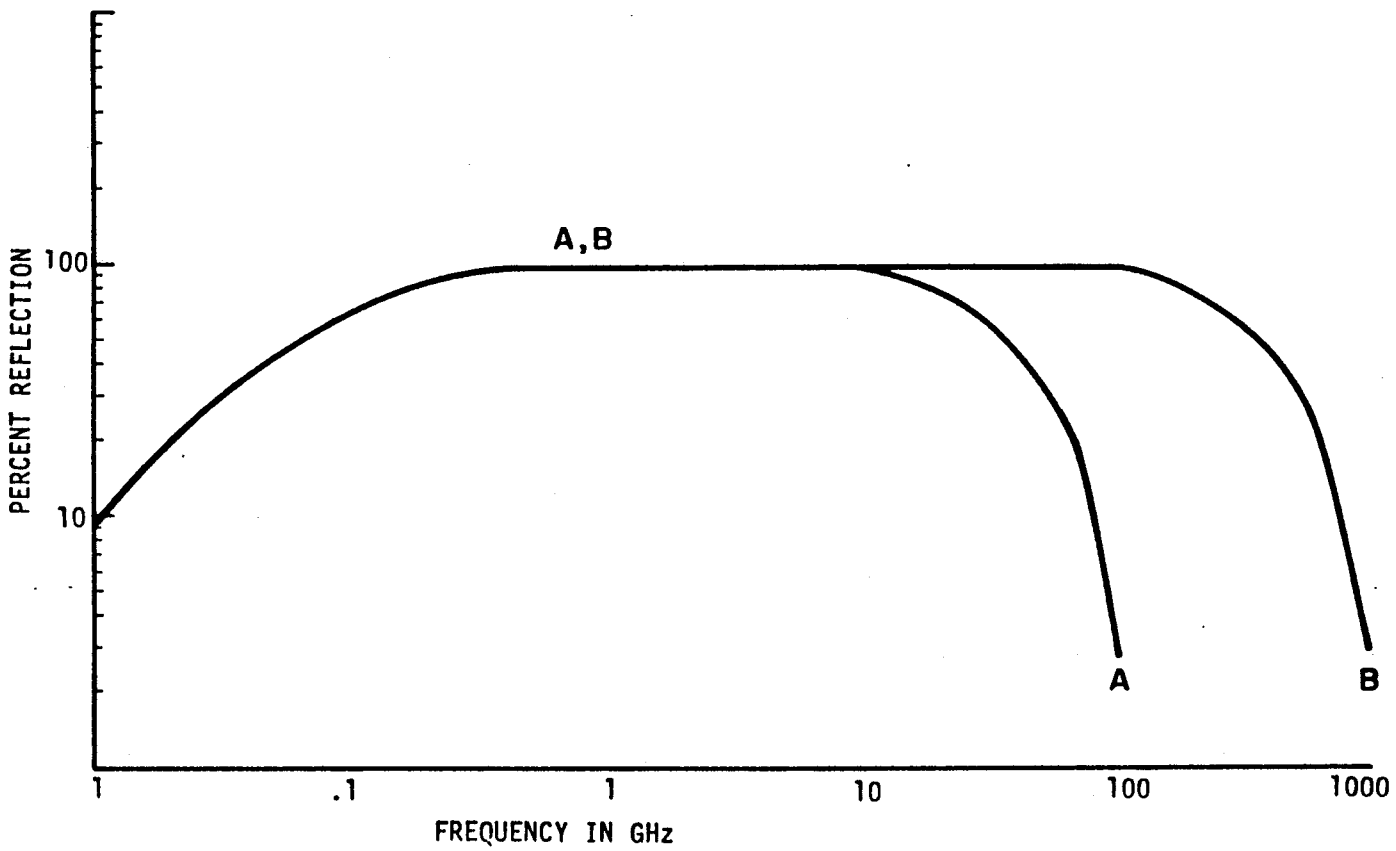
FIG. 9 is a graph of percent reflection as a function of frequency for dilute concentrations of efficient absorbing metallic particles supported in a slab of dielectric material.

Effective reflection bands for special cases of aluminum particles are shown in FIG. 9.

Extinction Lengths and Metal Mass Requirements

The extinction lengths and mass requirements for efficient absorbers (referred to as resonant absorbers) have been summarized parametrically and for the specific case of aluminum. The solid shapes requiring minimum mass are oblate spheroid disks of aspect ratios less than 10−6 and prolate spheroid rods of aspect ratios of less than $10^{-3}$. Nonmagnetic conductors, such as aluminum, with conductivities of $10^{17}$ $sec^{-1}$ densities of 2 gms/cc offer extreme efficiency in absorption with requirements of $4\times10^{-3}$ gms per square meter for greater than 95%, absorption and 4 gms per sq m for greater than 95%, reflection in the band of 1 to 100 GHz.

The extreme aspect ratio requirements for disks and rods are reduced for metallic coated spheroids of low permittivity low density material like polystyrene, while still maintaining a mass per unit area requirement that is comparable to the solid particle distribution (free space matching).

Summary, Extinction Lengths, Metal Mass Requirements for Dielectric Loading. [Aluminum taken as Example]

1. Extinction Lengths:

a) Absorption Length $$d_A = \frac{\lambda_1}{2\pi IM\sqrt{\epsilon}} = \frac{\lambda_1}{3\pi\beta} = \frac{\lambda_1}{2\pi\sqrt{1-A}},\ A > 0.95 \quad (42)$$

b) Reflection Length $$d_R = \frac{\lambda_1}{2\pi\sqrt{2}} = 0.11\,\lambda_1 \quad (43)$$

2. Mass Densities $$\text{a) Absorption } \frac{\text{Mass}}{\text{Area}} = \rho_m F d_A = \frac{\rho_m F\lambda_1}{3\pi\beta} \quad (44)$$

where $p_m$=density of metal [$cm^{-3}$]

$$\text{for aluminum, } \rho_m = 2.7,\ \sigma = 10^{17},\ \frac{\text{Mass}}{\text{Area}} = 3/9 \times 10^{-7}\ \text{gms/cm}^2 \quad (45)$$

$$\text{b) Reflection } \frac{\text{Mass}}{\text{Area}} = \rho_m F d_R = \frac{\rho_m F\lambda_1}{2\pi\sqrt{2}}$$

$$\text{for aluminum, } f_2/f_1 = 100,\ \beta_2 = \frac{\text{Mass}}{\text{Area}} = 4.1 \times 10^{-4}\ \text{gms/cm}^2 \quad (46)$$

$$\frac{\text{Mass absorption}}{\text{Mass reflection}} < \frac{\sqrt{2}}{1.5}\ \frac{f_1}{\beta_2 f_2} \leqq 0.094\frac{f_1}{f_2}$$

for $\beta_2 > 10$, $R > 0.95$

Particle Dimensions and Concentrations

In addition to having negligible depolarizing factors as in equation (5), the class of metallic particles considered as efficient absorbers must have the two smallness scales:

1) the particle must be a Rayleigh scatterer, hence its maximum dimension must be much less than the minimum wavelength of the incident electric field.
(2) the thickness or minimum dimension of the metallic portion of the particle must be less than the minimal skin depth, corresponding to the minimum wavelength.

For coherent effects , associated with a well-defined dielectric constant or permittivity, the separation between adjacent particle elements of a loaded dielectric must be less than ¼ minimal wavelength. Then for a constant volume fraction of metal , the phase of any in-band RF component is linear in the penetration depth.

Thus the smallness scales of a suitable particle that bound its largest dimension by ½π times its smallest wavelength and its smallest metallic dimension by the skin depth, are themselves interrelated by the interparticle distance bound of ¼ the smallest wavelength of the RF band.

On referring to the definition of the dimensionless variable β in equation (17), given in terms of metal conductivity σ, metal volume fraction F, and frequency f(Hz), certain particle parameters are determined. Since the particle is a Rayleigh scatterer, its length must be less than the smallest wavelength $\lambda_2$ in the RF band. The metal thickness must be less than skin depth of $\lambda_2$ with a net depolarizing factor that is less than $\sigma/\omega_2$.

Table 1 of appendix A summarizes the requirements for particle dimensions and number densities that are consistent with achieving high attenuation or high reflection, through proper choices of β (FIG. 7), and an interparticle separation distance of less than a quarter minimum wavelength permitting phase coherence within the loaded dielectric. The permittivity of the medium supporting the dilute concentration of particles is, for maximum absorption efficiency, chosen to be very close to free space.

The Table 2 of appendix A carries out a specific example through use of the relations of Table 1. The application is for RF Band: 1 GHz to 100 GHz Aluminum metal of conductivity $\sigma = 10^{17}$ $sec^{-1}$.

High Permittivity Supporting Dielectric ($\epsilon_1 >> 1$)

High Permittivity dielectrics can be used for RF shielding or waveguide material. When $\epsilon_1$, the permittivity of a low loss tangent dielectric supporting the particle loading is very much greater than 1, and the particles are in dilute concentrations, the first reflection effects are dominated by the large value of $\epsilon_1$, with the slab power reflection coefficient R given by equation (18) very close to unity, $$R = \left| \frac{\sqrt{\epsilon} - 1}{\sqrt{\epsilon} + 1} \right|^2 = 1 - \delta \tag{47}$$

Although the fraction $\delta$ can be very small it may not be satisfactory for very stringent absorption or shielding requirements.

By loading with very dilute concentrations of efficient absorbing metallic particles, as previously described, the amount of RF power further transmitted through a very thin, loaded, high permittivity, dielectric slab may be virtually eliminated by absorption.

Enhanced Volume Absorption

On referring to equations (12*a*) and (17), it is seen that for efficient absorbing particles, the condition $$\beta_{max}\left[\frac{\epsilon_1 + 2}{3}\right] \simeq 1 \tag{48}$$

where $\beta_{max}$ is given by (17) as $\beta_{max} = 2\sigma/9f_1$, $f_1 \leqq f \leqq f_2$). This gives rise to the imaginary part of the refractive index $$IM\sqrt{\epsilon} = \frac{3\beta(\epsilon_1 + 2)^2}{18} = \frac{\epsilon_1 + 2}{2} \tag{49}$$

which in turn signifies an extinction or attenuation depth within the loaded medium of $$d_A = \frac{\lambda_1}{\pi(\epsilon_1 + 2)} \tag{50}$$

for wavelengths $\lambda_2 < \lambda < \lambda_1$ (cm).

Thus, for high permittivity, $\epsilon >> 1$, the attenuation depth is inversely proportional to F-11 and the remaining portion of the incident field that penetrates the interior is absorbed within a few attenuation depths $d_A$, a slab thickness much smaller, by a factor $\sim 3/(\epsilon_1 + 1)$, than the corresponding low permittivity case in equation (24).

The required metal volume fraction F for this high absorption is implied by equations (48) and (49) as $$F = \frac{13.5 f_1}{(\epsilon_1 + 2)\sigma}, \tag{51}$$

frequency band $f_1 < f < f_2$ (Hz). For aluminum, this signifies a volume fraction of $$F = \frac{13.5 \times 10^{-8}}{\epsilon_1 + 2} f_1(\text{GHz})\ \epsilon_1 >> 1 \tag{52}$$

while for graphite or carbon the volume fraction F must be increased by three or more orders of magnitude because of the correspondingly lower conductivity. Therefore, transmission of incident radiation through a slab of high permittivity, which is thus loaded, is virtually zero, since first reflection effects are very high due to the high permittivity, and volume absorption is also very high within a very small thickness or depth of the material due to the metallic loading. For waveguide purposes, the significantly decreased extinction depth due to the dilute loading permits absorption band applications over much longer free space wavelengths.

Enhanced Reflectivity $$\text{When } \beta_{min}\left(\frac{\epsilon_1 + 2}{3}\right) >> 1, \tag{53}$$

namely for higher concentrations and for conductivities, it is seen that equation (12*a*) reduces to $$\frac{\epsilon}{\epsilon_1} = \frac{-2}{\epsilon_1}, \text{ or } \epsilon = -2, \epsilon_1 >> 1 \tag{54}$$

Here, the loading is increased over the absorption case, and consequently produces a totally reflecting surface. As in the low permittivity case, equation (37), the reflecting slab skin depth is $$d_R = \frac{\lambda_1}{2\pi\sqrt{2}} = 0.11\lambda_1, \epsilon_1 >> 1 \tag{55}$$

However, the requirement on volume fraction F is reduced by <s1>the factor $$\frac{3}{\epsilon + 2}$$

as $$F = \frac{13.5 f_2}{(\epsilon_1 + 2)\sigma} \tag{56}$$

Thus the reflecting slabs kin depths are the same for low ($1 \leqq \epsilon_1 < 1$) and high ($\epsilon_1 >> 1$) supporting dielectric permittivity. However, the required volume fraction of metallic loading is appreciably less in the high permittivity case.

Modifications of Tables 1 and 2 in Appendix

Because of the permittivity $\epsilon_1$, the Rayleigh size condition must be reduced by the factor of $\epsilon_1^{-\frac{1}{2}}$ and the particle concentration parameter $\beta$ by the factor $$\left(\frac{\epsilon_1 + 2}{3}\right)^{-1}.$$

Thus the parameters $K_1$ and $\beta$ in Table 1 must be modified for high $\epsilon_1$ by the following changes $$K_1 \text{ (high } \epsilon_1) = \epsilon_1^{-\frac{1}{2}} \times K_1 \text{ (low } \epsilon_1)$$

$$\beta \text{ (high } \epsilon_1) = \left[\frac{\epsilon_1 + 2}{3}\right]^{-1} \times \beta \text{ (low } \epsilon_1)$$

As a result, the scale factor bound of Table 1 for achievement of less than $\frac{1}{4}$ (medium) wavelength separation must be multiplied by the factor $$\epsilon_1\left(\frac{\epsilon_1+2}{3}\right)$$

This is significant for phase coherent effects, hence, primarily for total reflection.

The effects of these high permittivity changes in the example of Table 2 are scaling down of particle dimensions by $\epsilon_1^{-\frac{1}{2}}$, and increasing particle concentrations by $\epsilon_1(\epsilon_1+2)$, applicable to reflection conditions.

The absorption and reflection band characteristics for high $\epsilon_1$ are similar to the low $\epsilon_1$ case as shown in FIGS. 7 and 8.

Metal Coating Techniques

Ultrafine nonmetallic particles of low density, coated with a thin-skin depth or less-layer of conducting metal, offer efficient RF microwave absorption. Coating techniques include chemical precipitation metal spraying or condensing metal vapor. Of particular interest is the reduction of metal coating of powders by the Sherritt process described by B. Meddings, W. Kunda and V. Makiw, Preparation of Nickel Coated Powders, in *Powder Metallurgy,* W. Leszinski, editor, Interscience, New York, 1960. In the case of nickel, which is also of higher magnetic permeability, it is indicated that the only materials that would be expected to be completely and evenly coated with metal (nickel) by hydrogen reduction techniques would be those that are as at least as effective as hydrogenation catalysts as the metal in question. The Sherritt process offers a surface activation treatment of nickel by establishing surface activation centers with water insoluble anthraquinone. This method has also been applied to the preparation of nickel coated glass.

Production of Nonspherical Metal Particles

Production of nonspherical metal particles have been described by R. Dixon and A. Clayton, *Powder Metallurgy for Engineers,* Machinery Publishing Co. Ltd., 1971 (England) and B. Bakensto, Commercial Methods for Powder Production, in Vol. 3 *Iron Powder Metallurgy,* Editors Hausner, Rolland, Johnson, Plenum Press, New York, 1968. Micron size metallic particles are generally inefficient absorbers unless they form the constituents of filaments or flakes with very low depolarizing factors. Some methods of producing metallic dust particles give rise to filament or flake shapes as well as highly irregular surfaces which may offer substantially low depolarizing factor components. The following are among such methods:

- Atomization—a furnace melted precision fed atomizing jet stream.
- Electrolytic Technology—electrolytic deposition of powder flakes that are easily crushed to powder.
- Reduction of Oxides—reduces high grade (iron) magnetic concentrates, produces sponge iron - easily pulverized.
- MechanicalGrinding—used in manufacture of flake powder.
- Hydrometallurgy—precipitation of metal powders from hydrogen.

Production of Fiber Sized Particles

Production of fiber sized particles has been described by K. Spurny, Fiber Generation and Length Classification, in *Microwave Generation of Aerosols and Facilities for Exposure Experiments,* K. Willecke, Editor, Ann Arbor Science, Ann Arbor, Mich., 1980. Fiber shaped nonmetallic particles that can be used as nonconducting cores for metal layer deposition can be generated from dust or powder by means of a vibrating fluidized-bed principle. The powder is placed into a vibrating cylinder (made of metal or glass) and dried gas is passed vertically through the powder layer, forming a fluidized bed. The aerosol generation is controlled by the equilibrium state developing between the disintegrating and reagglomerating of the powders or fibers in the surface layer of the vibrating bed. The vibration breaks the cohesion between the particles or fibers so that they are free to be carried away by the gas stream. This method permits dust clouds of constant concentration to be generated for periods of several hours or several days.

Acoustic agglomeration of aerosols has been described by D. Shaw, *Acoustic Agglomeration of Aerosols* in *Generation of Aerosols and Facilities for Exposure Experiments,* ; K. Willecke, Editor, Ann Arbor Science, Ann Arbor, Mich., 1980. The method has some similarities to the method of acoustic agglomeration of aerosols where a fixed mass of powder is exposed to an acoustic pressure field. The number density of small aerosols decreases as the aerosol size increases by agglomeration while the total mass remains constant. Acoustic generation has been successful by growth rate control. Both ultrasonic standing waves and progressive sawtooth waveforms of the order of 100 Hz have been effective.

Whisker and filament production has been described by G. Piatti, Preparation of New Multi-Phase components in *Proceedings of the International School of Physics, Enrico Fermi, Course LXI,* Edited by G. Caglotti, North Holland, 1978. The manufacturing of materials in the form of metal fibers, or whiskers, are of importance in metallurgical technology because of their exceptionally high mechanical resistance. These whiskers have a very high length to diameter ratio with diameters in the micron or submicron range and lengths of the order of meters. Hence by segmenting or controlled growth they can be the basis of production of resonant absorbing filaments or rods, Rayleigh size in length, skin depth in diameter. The technique of unidirectional solidification achieves in a single process the on site growth of fibers. These whiskers are based on a technique for the fabrication of continuous metal filaments with growth from the liquid stage called EFG—"edge defined, film fed growth." They consist of continuous mono crystals with micron diameters and meter lengths.

An opposing jet classifier technique is described by K. Willecks and R. Pavlik, *Opposing Jet Classification,* in *Generations of Aerosols and Facilities for Exposure Experiments,* supra . A jet of particle laden air is directed against an equally strong axisymmetrically opposed jet of clean air. Higher inertia particles deviate across the air streamlines and cross the fluid interface between jets, while lighter ones are carried with the original air stream. Once separated, the two particle fractions can be directed to any desired location for further size classification. This method provides sharp particle size separation above and below a desired aerosol-dynamic cut size with both effluent particle fractions remaining in the airborne state, and permits extraction of narrow particle size range from a polydisperse aerosol cloud.

Present research is focussed on the suppression of the edgetone effect and the elimination of high particle losses for small separation plate hole sizes. The fluidized bed is comprised of the inert metallic particles. For a constant output from the generator the particles are transported from a powder holding chamber to the fluidized bed by a chain conveyor system driven by a variable speed motor which controls the dust quantity delivery.

Stored particles in dielectric material may undergo change in their properties due to aging with time and chemical reactions with the material. Aging may be caused by oxidation and/or solid-solid diffusion. The oxidation and diffusion rates can be estimated if the composition of the dielectric materials can be obtained from the manufacturers.

The small particles of some metals may agglomerate easily due to cold welding effect. For example, pure aluminum particles agglomerate easily under pressure, but if they are coated with a thin (a few tens of Angstroms) layer of aluminum oxide they would not agglomerate easily for the same conditions. Various coatings can be used to prevent agglomeration but not to change their absorptive properties. For example, a metallic particle coated thinly with a nonreactive teflon would minimize agglomeration. The particles in an appropriate liquid medium will remain dispersed. Thus, agglomeration can be prevented by various techniques and the most suitable technique can be evaluated analytically for a particular application before performing any experiments.

The small volume fractions of efficient absorbing particles needed for high absorption and/or high reflection must be mixed properly with an RF-transparent sustaining material. For example, in the GHz region, and for aluminum, this may entail metal mixing volume fractions of less than $10^{-7}$ for absorption, or less than $10^{-5}$ for reflection with a very lightweight sustaining material such as polyurethane foam.

It is reasonable to carry out this mixing of such dilute concentrations of metallic particles with the unfoamed polyurethane and then generate the foamed version of the mixture. Since the volume fraction of polyurethane in the foam may be 1/10 to 1/50thless than the volume fraction of is foam, the metal volume fraction to be mixed with the unfoamed material must correspondingly be increased by 10 to 50 times in order to maintain the proper volume fraction in the foamed mixture.

Thus the synthetic dielectric composition process should consist of mixing and foaming. Various conventional mixing methods may apply. The plastic material may be powdered and a suitable concentration or volume fraction of metallic particles may be mixed by (1) Fluidized Bed Principle described by J. J. Licardi , *Plastic Coatings for Electronic Materials,* Chapt. 5 McGraw Hill, New York, 1970. The dry powdered insulator material, polyurethane, is placed in a container and set in motion by controlled veocity air or inert gas introduced from the bottom of the container through a screen or powder membrane. The resultant low density powder is in constant motion and behaves as a fluid, to which is added the proper concentration of metallic particles. After some minutes of mixing the resultant powder is allowed to settle and is collected. (2) Intensive Dry Mixer described by J. Frados, editor, *Plastics Engineering Handbook,* Chapt. 29, Van Nostrand Reinhold, New York, 1976. Here the dry blending principle is used. A typical mixer consists of a high-speed propeller like impeller located at the bottom of a container. Heat generate during the blending cycle is continuously removed to stabilize the dry blend and improve flow characteristics.

Particle suspension in liquefied plastic. The plastic may be kept in a molten, liquid to which the measured metal particle content are added, the mixture stirred to produce a uniform suspension, and subsequently allowed to cool.

After mixing, the loaded plastic can be foamed in various ways. As described in the literature, air is whipped into a suspension or solution of the plastic which is hardened by heat or catalytic action. Alternatively, a gas is dissolved in the mix and expands when pressure is released. Another technique is heating the mix containing a volatile liquid compound. Yet another technique is to use chemical reaction within the mass to produce carbon dioxide, or liberation of gas such as nitrogen within the mass by thermal decomposition of a chemical blowing agent .

For the manufacture of polyurethane foam, compounds containing hydroxyl groups of high molecular weight are mixed with diisocyanades and water. Carbon dioxide is evolved as a foaming agent. The reaction mixture is cast in molds in which both the foaming and hardening process take place. Blocks of foam are cut up into slabs on sheets by cutting machines.

Although particular embodiments of the invention have been described and illustrated herein, it is recognized that variations and equivalents may readily occur to those skilled in the art. Consequently, it is intended that the claims be interpreted to cover such variations and equivalents.

What is claimed is:

1. A method of providing material for RF broadband-selected interaction of a type chosen from the alternatives of absorption and its compliment, reflection, using dilute concentrations of metallic particles suspended in a solid dielectric, comprising the steps of forming from metallic material of known conductivity spheroidal Rayleigh conducting particles, each particle having at least the outer shell made of said metallic material, said particles being provided with a low depolarizing factor less than the applied frequency-to-conductivity ratio, $\omega/\sigma$, for the lowest frequency, $f_1$, of the selected band, $f_1$ to $f_2$, each of said particles having at least one submicron dimension less than skin depth, $\delta r_{sk}$, given by the equation $$\delta r_{sk} = \frac{\lambda_2}{2} \sqrt{\frac{f_2}{\mu o}}$$

where $\mu$=magnetic permeability $\sigma$=conductivity of the metallic particle $\lambda_2$=wavelength at lowest frequency of selected band forming said solid dielectric, and uniformly distributing said particles in said solid dielectric at the time said solid dielectric is formed with a volume fraction F of constituent metallic material of said particles selected for the known electrical conductivity of said constitutent metallic material to provide a small product of volume fraction and electrical conductivity sufficient for RF absorption in said dielectric material of at least a given thickness, and to provide a product of volume fraction F and electrical conductivity that is increased by at least two orders of magnitude for reflection, said dielectric material being so loaded for a thickness of at least the order of one tenth the longest in-band free-space wavelength, whereby, for any given RF frequency bandwidth, a volume fraction of conductivity equal to approximately half that of the lowest in-band frequency will produce very high absorption within the thickness of dielectric material of the order of the corresponding in-band wavelength, and an increase of this volume fraction F of conductivity by at least two orders of magnitude will thus produce correspondingly high reflection within a thickness of the order of one tenth the longest in-band free-space wavelength.

2. A method as defined in claim 1 for absorption of a selected band $f_1$ to $f_2$, wherein said loaded dielectric is provided with a thickness d greater than the wavelength at the lower frequency $f_1$ of said band, and said metallic particles are provided with a metallic thickness $\delta r$ of less than the skin depth $\delta r_{sk}$ of the highest frequency $f_2$ and a depolarizing factor $P_e$ less than $2\pi f_1/\sigma$.

3. A method as defined in claim 1 for reflection of a selected band $f_1$ to $f_1$, wherein said loaded dielectric is provided with a thickness d greater than the wavelength at the lower frequency $f_1$ of said band, and said metallic particles are provided with a metallic thickness $\delta r$ of less than the skin depth $\delta r_{sk}$ of the highest. frequency $f_2$ and a depolarizing factor $P_e$ less than $2\pi f_1/\sigma$, and said particles are provided with an effective volume fraction F increased inversely proportional to the square root of the higher frequency $f_2$.

4. A method as defined in claim 1, 2 or 3, wherein said particles are formed as prolatespheroids and are uniformly distributed with at least one third of the particles oriented with their major axes parallel to the electric field vector of incident radiation, and all particles are formed with a minor to major axis aspect ratio a /a that are less than the square root of $f/\sigma$divided by $\ln\sigma/f+\ln\ln\sigma/f$, where f is the lower frequency $f_1$ of said selected band, and a is the conductivity of the metallic material used in forming the particles.

5. A method as defined in claim 4 wherein said particles are formed as solid metallic particles.

6. A method as defined in claim 4 wherein said particles are formed as metallic coated low permittivity solid dielectric particles, and the metallic coating thickness is less than the minimum skin depth associated with the highest frequency of said band.

7. A method as defined in claim 1, 2 or 3 wherein said particles are formed as oblate spheroids and are uniformly distributed with at least one third of the particles oriented with their major axis parallel to the electric field vector of incident radiation, and all particles are formed with a minor to major axis aspect ratio $a_2/a_1$ that are less than $f_1/\sigma$, where $f_1$ is the lower frequency of said selected band, and $\sigma$ is the conductivity of the metallic material used in forming the particles.

8. A method as defined in claim 7 wherein said particles are formed as solid metallic particles.

9. A method as defined in claim 7 wherein said particles are formed as metallic coated low permittivity solid dielectric particles, and the metallic coating thickness is less than the minimum skin depth associated with the highest frequency of said band.

10. A slab of synthetic material loaded with dilute concentrations of conductive spheroidal particles for broadband interaction of a type chosen from the alternatives of absorption and its complement, reflection, of RF energy in a selected band, said particles being Rayleigh scatterers of maximum linear dimension less than the smallest wavelength in said band and having a thickness of conductive material less than the skin depth for the highest frequency to be absorbed, and said slab having a thickness greater than the maximum wavelength of said band in the synthetic material.

11. A slab of synthetic material loaded with dilute concentrations of conductive particles as defined in claim 10, wherein said particles are prolate spheroids with at least one third of the particles oriented with their major axis parallel to the electric field vector of incident radiation, and all particles have a minor to major axis aspect ratio $a_2/a_1$ that are less than the square root of $f/\sigma$divided by $\ln \sigma/f+\ln\ln \sigma/f$, where f is the lower frequency $f_1$ of said selected band, and $\sigma$ is the conductivity of the metallic material used in forming the particles.

12. A slab of synthetic material loaded with dilute concentrations of conductive particles as defined in claim 10 wherein said particles are oblate spheroids with at least one third of the particles oriented with their major axis parallel to the electric field vector of incident radiation, and all particles have a minor to major axis aspect ratio $a_2/a_1$ that are less than $f/\sigma$, where f is the lower frequency $f_1$ of said selected band, and $\sigma$ is the conductivity of the metallic material used in forming the particles.

13. A slab of synthetic material loaded with dilute concentrations of conductive particles as defined in claim 11 or 12 wherein said particles are solid metallic particles.

14. A slab of synthetic material loaded with dilute concentrations of conductive particles as defined in claim 11 or 12 wherein said particles are metallic coated low permittivity solid dielectric particles, and the metallic coating thickness is less than the minimum skin depth associated with the highest frequency of said band.

* * * * *

UNITED STATES PATENT AND TRADEMARK OFFICE

CERTIFICATE OF CORRECTION

PATENT NO. : 5,298,903

DATED : March 29, 1994

INVENTOR(S) : William A. Janos

It is certified that error appears in the above-indentified patent and that said Letters Patent is hereby corrected as shown below:

Column 2, line 30 delete the equation and substitute --

$$\delta r_{sk} = \frac{\lambda_2}{2\pi}\sqrt{\frac{f_2}{\mu\sigma}} \quad (esu, cgs)$$ --

Column 2, line 36, delete "λ" and substitute -- $\lambda_2$ --

Column 4, line 43, delete the equation and substitute --

$$P_e = \iint_{surface} dy_s dx_s \frac{\partial}{\partial_z}[(x-x_s)^2+(y-y_s)^2+(z-z_s)^2]^{-\frac{1}{2}}$$ --

Column 5, line 3, delete "<E>" and substitute -- $<E_k>$ --

Column 5, line 18, delete "$\omega = \pi f$," and substitute -- $\omega = 2\pi f$, --

Column 5, line 46, delete "a2/a1" and substitute -- $a_2/a_1$ --.

Column 8, line 38, delete "Δ" and substitute -- $|\epsilon|$ --

Column 9, line 45, delete the equation and substitute --

$$f > f_1 > \frac{\sigma}{2\pi} P_e,$$ --

UNITED STATES PATENT AND TRADEMARK OFFICE

CERTIFICATE OF CORRECTION

PATENT NO. : 5,298,903
DATED : March 29, 1994
INVENTOR(S) : William A. Janos

It is certified that error appears in the above-indentified patent and that said Letters Patent is hereby corrected as shown below:

Column 10, line 15, delete "a" of second occurrence and substitute -- $\beta$ --

Column 10, line 46, delete "=" and substitute -- $\simeq$ --

Column 11, line 32, delete "10-6" and substitute -- $10^{-6}$ --

Column 11, line 68, delete "$p_m$" and substitute -- $\rho_m$ --

Column 12, line 36, delete "½$\pi$" and substitute -- $\frac{1}{2\pi\sqrt{\mu}}$ --

Column 13, line 43, delete "F-11" and substitute -- $\epsilon_1$ --

Column 13, line 59, delete the equation and substitute --

$$F = \frac{13.5 \times 10^{-8}}{\epsilon_1 + 2} f_1(GHz), \quad \epsilon_1 >> 1$$

Column 14, line 31, delete "<s1>"

Column 18, line 35, delete "compliment" and substitute -- complement --

UNITED STATES PATENT AND TRADEMARK OFFICE

CERTIFICATE OF CORRECTION

PATENT NO. : 5,298,903
DATED : March 29, 1994
INVENTOR(S) : William A. Janos

It is certified that error appears in the above-indentified patent and that said Letters Patent is hereby corrected as shown below:

Column 18, line 50, delete the equation and substitute --

$$\delta r_{sk} = \frac{\lambda_2}{2\pi}\sqrt{\frac{f_2}{\mu\sigma}} \quad (esu, cgs)$$ --

Column 19, line 23, delete "$f_1$ to $f_1$" and substitute -- $f_1$ to $f_2$ --

Insert Appendix A, TABLES 1 and 2 attached, and in TABLE 1, line 2, after "$2\pi$" in both occurrences, insert -- $\sqrt{\mu}$ --, and in the caption at the bottom insert -- , $\mu$=1 --.

UNITED STATES PATENT AND TRADEMARK OFFICE

CERTIFICATE OF CORRECTION

PATENT NO. : 5,298,903

DATED : March 29, 1994

INVENTOR(S) : William A. Janos

It is certified that error appears in the above-indentified patent and that said Letters Patent is hereby corrected as shown below:

RF Band $f_1 < f \leq f_2$ Hz. Absorption Emphasized*

Scale factor $K_1 > 2\pi$ assures that particle is Rayleigh Scatterer, $L = 2a_1 = \lambda_2/K_1 < \lambda_2/2\pi$

| Particle Description | $K_2$ Scaling Definition | Particle Concentration* | Scale factor bound for inter-particle separation $< \lambda_2/4$* |
|---|---|---|---|
| Solid metal rod or prolate Spheroid | $K_2$ Scales skin depth thickness $a_2 = \frac{1}{K_2}\delta r_{sk}$ | $1.3 \times 10^{-2}\beta$ / $XK_1K_2^2 f_1(\text{GHz}) f_2^2(\text{GHz})$ | $K_1K_2^2 > \frac{0.19}{\beta}\left(\frac{f_2}{f_1}\right)$ |
| Solid metal flake or oblate Spheroid | $K_2$ Scales depolarizing factor $a_2 = \frac{1}{K_2}\frac{\omega_1 a_1}{\sigma}$ | $10^{-4}\beta$ / $XK_1^3K_2 f_2^3(\text{GHz})$ | $K_1^3K_2 > \frac{24}{\beta}$ |
| Metallic coated Spheroid | Scales skin depth thickness of metal layer $\delta r = \frac{1}{K_2}\delta r_{sk}$ | $4.0\times10^{-5}\left(\frac{10^9}{\sigma}\right)^{1/4}\beta$ / $XK_1^2K_2 f_1^{1/2}(\text{GHz}) f_2^{11/4}(\text{GHz})$ | $K_1^2K_2 > \frac{59}{\beta} f_1^{-1/2}(\text{GHz})\left(\frac{\sigma f_2(\text{GHz})}{10^9}\right)^{1/4}$ |
| Metallic Coated prolate Spheroid | Semi major axis bound, $a_2 < \sqrt{\frac{f_1}{2\sigma}\frac{a_1}{\delta r}^3} \times \left(\ln\left(\frac{a_1}{\sqrt{\frac{f_1}{2\sigma}\frac{a_1}{\delta r}^3}}\right)\right)^{-1}$ | | |

$\delta r_{sk}$ = Skin depth = $\frac{c}{4\pi}\sqrt{\frac{1}{\mu f_1 \sigma}}$ $\beta \leq .1$ Corresponds to high absorption, at <u>least</u> 95%

$\beta \geq 10.$ Corresponds to high reflection, at <u>least</u> 95%, *for reflection, replace $\beta$ by $\beta\frac{f_2}{f_1}$.

TABLE 1 Summary of Particles Smallness Scales and Concentrations

UNITED STATES PATENT AND TRADEMARK OFFICE

CERTIFICATE OF CORRECTION

PATENT NO. : 5,298,903

DATED : March 29, 1994

INVENTOR(S) : William A. Janos

It is certified that error appears in the above-indentified patent and that said Letters Patent is hereby corrected as shown below:

Example: RF Band 1 GHz to 100 GHz
Aluminum, Conductivity $\sigma = 10^{17} Sec^{-1}$

| Particle Description | Particle Dimensions, $a_1 a_2$ | | Concentration $cm^{-3}$ | |
|---|---|---|---|---|
| | Semi major axis $a_1$ | semi minor axis $a_2$ | high absorption | high reflection |
| Solid Prolate Spheroid | $a_1 = \lambda_2/2K_1$ <br> $K_1 = 10 \rightarrow a_1 = .015cm$ | $K_2 = 10 \rightarrow a_2 = 1.4 \times 10^{-6} cm$ | $1.3 \times 10^2$ | $1.3 \times 10^6 cm^{-3}$ |
| Metal Layered Spheroid: | Semi major axis $a_1$ <br> $K_1 = 100 \rightarrow a_1 = .0015$ | metal layer thickness $\delta r_s$ <br> $K_2 = 10 \rightarrow \delta r = 1.4 \times 10^{-6}$ | $4.0 \times 10^3$ | $4.0 \times 10^7$ |
| Prolate | Semi minor axis $a_2$ <br> $a_2 = 1.6 \times 10^{-4}$ | | | |

TABLE 2

Signed and Sealed this

Eleventh Day of April, 1995

Bruce Lehman

*Attest:*

BRUCE LEHMAN

*Attesting Officer*

*Commissioner of Patents and Trademarks*